US005873494A

United States Patent [19]

Dallas, Jr.

[11] Patent Number: 5,873,494

[45] Date of Patent: Feb. 23, 1999

[54] DUAL STREAM LIQUID DISPENSING STRUCTURE

[75] Inventor: Milton R. Dallas, Jr., East Troy, Wis.

[73] Assignee: AptarGroup, Inc., Crystal Lake, Ill.

[21] Appl. No.: 924,633

[22] Filed: Sep. 5, 1997

[51] Int. Cl.[6] ..... B67D 5/56

[52] U.S. Cl. ..... 222/129; 222/145.4; 222/212; 222/484; 222/556

[58] Field of Search ..... 222/94, 129, 145.3, 222/145.4, 212, 482, 484, 556

[56] References Cited

U.S. PATENT DOCUMENTS

| | | | |
|---|---|---|---|
| 3,542,256 | 11/1970 | Waterman | 222/484 |
| 3,729,553 | 4/1973 | Gold et al. | 424/44 |
| 4,029,236 | 6/1977 | Carson, Jr. et al. | 222/135 |
| 4,645,086 | 2/1987 | Rosenthal | 215/235 |
| 4,776,501 | 10/1988 | Ostrowsky | 222/517 |
| 4,884,703 | 12/1989 | O'Meara | 215/6 |
| 4,964,539 | 10/1990 | Mueller | 222/94 |
| 4,974,756 | 12/1990 | Pearson et al. | 222/562 |
| 5,020,694 | 6/1991 | Pettengill | 222/137 |
| 5,058,775 | 10/1991 | Gross et al. | 222/153 |
| 5,062,550 | 11/1991 | Singh | 222/80 |
| 5,137,178 | 8/1992 | Stokes et al. | 222/94 |
| 5,147,072 | 9/1992 | Dirksing | 222/212 |
| 5,158,191 | 10/1992 | Douglas et al. | 215/10 |
| 5,252,312 | 10/1993 | Gentile et al. | 424/44 |
| 5,284,264 | 2/1994 | Gross | 215/237 |
| 5,341,960 | 8/1994 | Lay | 222/153 |
| 5,379,926 | 1/1995 | Mueller et al. | 222/507 |
| 5,593,065 | 1/1997 | Harrold | 222/94 |
| 5,765,725 | 6/1998 | Matt | 222/212 |

*Primary Examiner*—Joseph A. Kaufman
*Attorney, Agent, or Firm*—Rockey, Milnamow & Katz, Ltd.

[57] ABSTRACT

A dispensing structure is provided for a container which has first and second storage compartments and first and second discharge openings each separately communicating with one of the first and second storage compartments, respectively. The dispensing structure includes a body for extending from the container. The body has a peripheral wall that defines first and second discharge conduits for communicating with the first and second discharge openings, respectively. The dispensing structure also includes first and second dispensing conduits mounted in the body peripheral wall for tilting movement between (1) a dispensing position in which the first and second dispensing conduits are in fluid communication with the first and second discharge conduits, respectively, and (2) a non-dispensing position. The first and second conduits include, respectively, first and second sealing plugs therein for occluding flow from the first and second discharge conduits, respectively, when the first and second dispensing conduits are in the closed position and for permitting flow from the first and second discharge conduits when the first and second dispensing conduits are in the open position.

11 Claims, 4 Drawing Sheets

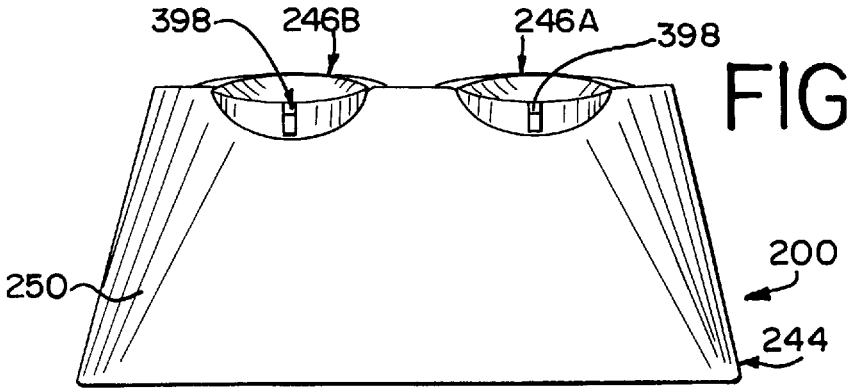
FIG. 10
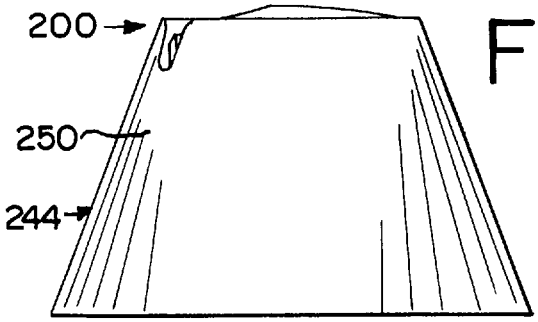
FIG. 11
FIG. 12
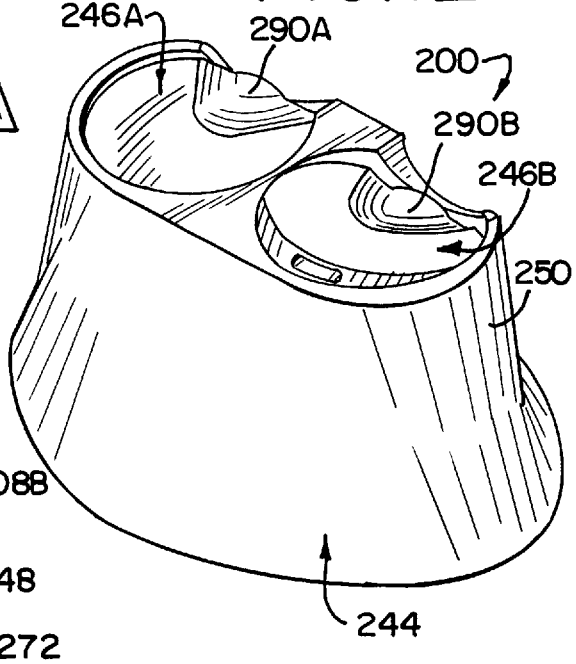
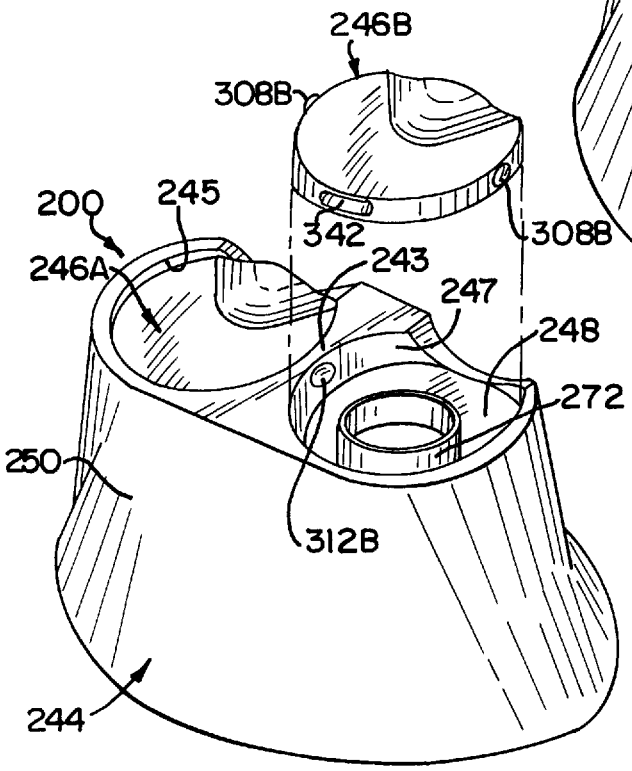
FIG. 13

DUAL STREAM LIQUID DISPENSING STRUCTURE

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a system for dispensing two materials or products from a container. The invention is more particularly related to a system incorporating a dispensing structure which accommodates the dispensing of two streams of material side by side. The invention is especially suitable for dispensing two different materials from two compartments in a container.

BACKGROUND OF THE INVENTION AND TECHNICAL PROBLEMS POSED BY THE PRIOR ART

A variety of packages that include dispensing systems on containers have been developed for household products, personal care products, and other products. It would be desirable to provide an improved dispensing structure for use with such systems.

In some potential product applications, it may be advantageous to provide two different materials which are mixed together to form a useful composition, but which are preferably stored separately prior to use. Separation may be required because of chemical reactivity or physical incompatibility during the storage period. Such compositions may include health and beauty aids, cleaning compositions, and dental formulas.

It might also be desirable to provide a single container, having two internal compartments, which can dispense different food products simultaneously or separately. For example, it might be desirable to have a single container from which ketchup can be dispensed as well as mustard.

Double barrel dispensing containers may be employed for storing different reactive ingredients, such as an epoxy resin in one barrel and a curing agent in the other barrel. Generally equal portions of the epoxy resin and curing agent can then be simultaneously dispensed for immediate mixing, and no measuring of the separate ingredients is necessary.

A variety of closure designs have been provided for containers which hold two different materials. However, there is a need to provide a dispensing structure for such containers which is very easy to operate. Preferably, such an improved dispensing structure should provide an integral mechanism that eliminates removable caps or other parts which have to be set aside during use of the container and which may become misplaced or damaged.

Further, such an improved dispensing structure should provide a very effective seal when the dispensing structure is closed so as to avoid subjecting the materials in the container to prolonged exposure to air and so as to avoid contamination of the materials within the container owing to contaminant ingress.

Such an improved dispensing structure should also accommodate designs which permit incorporation of the dispensing structure as a unitary part, or extension, of the container and which accommodate the separate mounting of the dispensing structure on the container in a secure manner.

Preferably, the dispensing structure should operate to maintain the two materials being dispensed in separate streams until the streams exit the dispensing structure. The dispensing structure should preferably be able to dispense the streams of the two different materials substantially simultaneously.

It would also be beneficial if such an improved dispensing structure could readily accommodate its manufacture from a variety of different materials.

Further, it would be desirable if such an improved dispensing structure could be provided with a design that would accommodate efficient, high quality, large volume manufacturing techniques with a reduced product reject rate.

Preferably, the improved dispensing structure should also accommodate high speed manufacturing techniques that produce products having consistent operating characteristics unit-to-unit with high reliability.

The present invention provides an improved dispensing structure which can accommodate designs having the above-discussed benefits and features.

SUMMARY OF THE INVENTION

According to one aspect of the present invention, a dispensing structure is provided for a container of flowable materials, such as a liquid, cream, or paste, so as to dispense two side-by-side streams of the materials.

The dispensing structure is adapted for use on, or as part of, a container having first and second storage compartments and first and second discharge openings which each separately communicate with one of the first and second storage compartments, respectively.

The dispensing structure includes a body for extending from the container. The body has a peripheral wall and defines first and second discharge conduits for communicating with the first and second discharge openings, respectively, in the container. First and second dispensing conduits are mounted in the body peripheral wall for tilting movement between (1) a dispensing, open position in which the first and second dispensing conduits are in fluid communication with the first and second discharge conduits, respectively, and (2) a non-dispensing, closed position. The first and second dispensing conduits include, respectively, first and second sealing members therein for occluding flow from the first and second discharge conduits, respectively, when the first and second dispensing conduits are in the closed position and for permitting flow from the first and second discharge conduits when the first and second dispensing conduits are in the open position.

In a preferred embodiment, the dispensing structure is a separate closure adapted to be mounted to the top of a container having an end wall defining the first and second discharge openings. In one of the preferred embodiments, the body peripheral wall defines a central recess around the first and second discharge conduits. The first and second dispensing conduits are defined in a single actuator which is disposed in the central recess and which is pivotally mounted in the body peripheral wall. The peripheral wall defines two spaced-apart engaging surfaces defining a pivot axis extending across a portion of the central recess. The actuator defines two oppositely directed engageable surfaces which are each matingly engaged with one of the peripheral wall engaging surfaces to pivotally mount the actuator to the peripheral wall.

In the preferred embodiment, the container end wall first and second discharge openings are defined by first and second outlet tubes, respectively, projecting from the end wall of the container. The dispensing structure is a separate closure adapted to be mounted over the end wall of the container. The body of the dispensing structure includes a snap-fit element for establishing a snap-fit engagement with a cooperating snap-fit element on the container to mount the body on the container. The body includes (1) a deck, (2) first and second apertures in the deck, (3) first and second lower tubes projecting downwardly from the deck around the first and second apertures, respectively, and (4) first and second upper tubes projecting upwardly from the second deck around the first and second apertures, respectively. The first upper tube and the first lower tube together define the firstdischarge conduit in the body, and the second upper tube and the second lower tube together define the second discharge conduit in the body. Each body lower tube is adapted to be received in, and sealingly engage the interior edge of, one of the container outlet tubes. Each body upper tube is adapted to be received in, and sealingly engage the exterior edge of, one of the sealing members when the dispensing conduits are in the closed position.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIG. 10 is a rear elevational view of the dispensing structure shown in FIG. 8;

FIG. 11 is a right side elevational view of the dispensing structure shown in FIG. 10;

FIG. 12 is a front, perspective view of the dispensing structure shown in FIGS. 8–11, but FIG. 12 shows the right-hand actuator in a dispensing, open position;

FIG. 13 is a view similar to FIG. 12, but FIG. 13 shows the right-hand actuator exploded off of the body and oriented in the closed position.

DESCRIPTION OF THE PREFERRED EMBODIMENT

Figure 1:
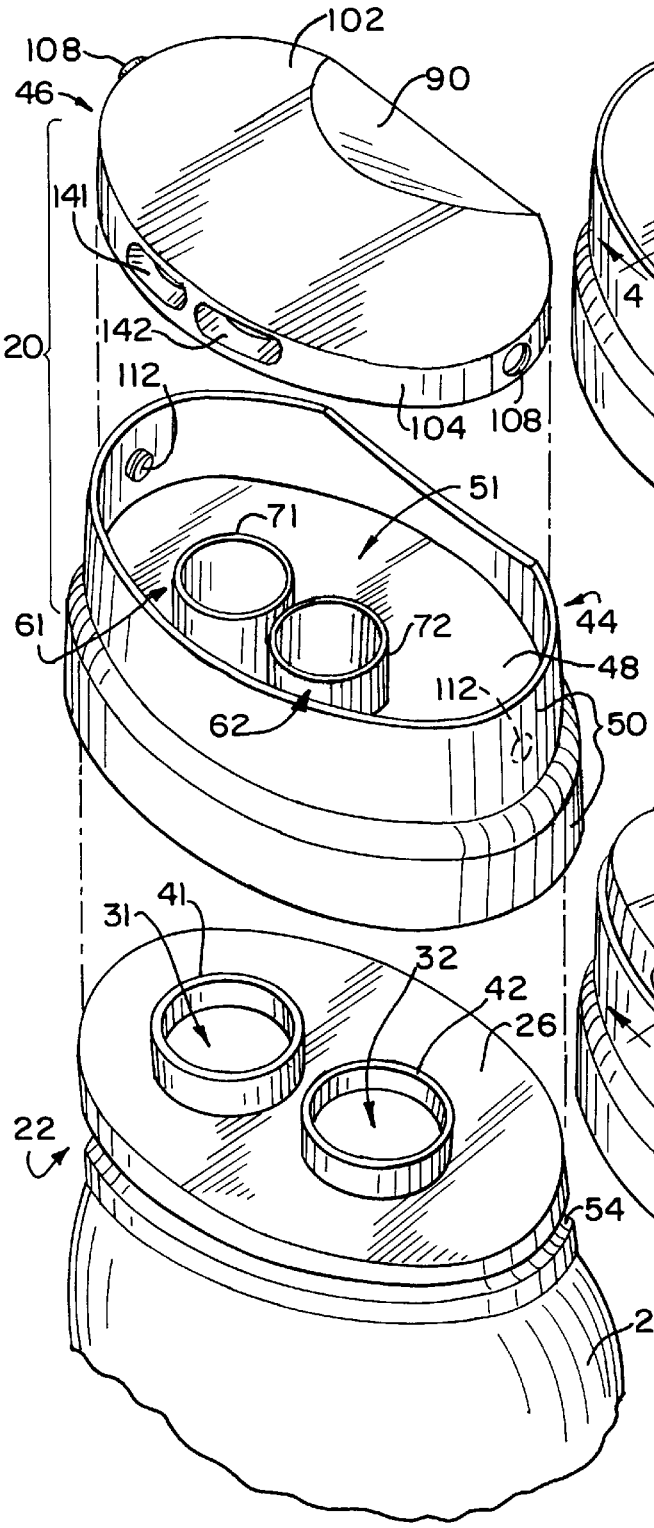
FIG. 1 is an exploded, front, perspective, fragmentary view of a first embodiment of the dispensing structure of the present invention shown with the actuator in the closed position.

While this invention is susceptible of embodiment in many different forms, this specification and the accompanying drawings disclose only some specific forms as an examples of the invention. The invention is not intended to be limited to the embodiment so described, and the scope of the invention will be pointed out in the appended claims.

For ease of description, the dispensing structure of this invention is described in a typical upright position, and terms such as upper, lower, horizontal, etc., are used with reference to this position. It will be understood, however, that the structure may be manufactured, stored, and used in orientations other than the one described.

A presently preferred, first embodiment of a dispensing structure of the present invention is illustrated in FIGS. 1–7 and is designated generally therein by the reference numeral 20. The dispensing structure is provided in the form of a closure 20 which is adapted to be mounted on a container 22. The body 20 of the container 22 may have any suitable configuration, such as an oval, cross-sectional shape, for example. The container 22 typically has a body 24 with an end wall 26.

The container 22 may typically be a deformable, collapsible container with first and second interior storage compartments or squeezable bags (not visible) which each contains a different flowable material or product and which are open at the top to define first and second discharge openings 31 and 32, respectively. The interior storage compartments may be defined by the exterior wall of the container and an interior divider wall (not illustrated).

However, the interior compartments could instead be defined by other structures, such as separate, internal compartments, cylinder/piston mechanisms, collapsible bags, or the like. The container 22 may be fabricated from a suitable material that permits the container to be at least temporarily squeezed or compressed. For example, the container may have the form of a tube and may be readily molded from an appropriate synthetic plastic material such as polyvinyl or polyethylene. On the other hand, the container 22 may be fabricated from other materials, such as thin metal, for example, aluminum, tin, lead, or the like. The container 22 could also be a blow-molded container.

The container may be a squeezable container having a flexible wall or walls which can be grasped by the user and compressed to increase the internal pressure within the container so as to squeeze the product out of the container through the closure when the dispensing structure or closure 20 is opened. The container wall typically has sufficient, inherent resiliency so that when the squeezing forces are removed, the container wall returns to its normal, unstressed shape. Such a structure may be preferred in some applications, but may not be necessary or preferred in other applications.

The container 22 may also be a substantially rigid container having telescoping moving parts which permit one portion of the container to be pushed relative to the other to decrease the interior volume and force the materials from within the container compartments out through the dispensing structure or closure 20 when the dispensing closure 20 is opened. Alternatively, other suitable means may be provided for applying pressure to the materials within the compartments inside the container 22 so as to force the material out of the container 22.

So long as the container 22 has a first discharge opening 31 and a second discharge opening 32, the detailed design and operation of other features of the container form no part of the present invention. Although the container, per se, need not necessarily form a part of the present invention, per se, it will be appreciated that the dispensing structure of the present invention may be provided as a unitary portion, or extension, of the top of the container. However, in the preferred embodiments illustrated, the dispensing structure 20 is a separate element which is adapted to be mounted to a previously manufactured container having a first discharge opening 31 and a second discharge opening 32. In the preferred embodiment, the first discharge opening 31 is defined by a first outlet tube 41, and the second discharge opening 32 is defined by a second outlet tube 42 (FIG. 1).

Figure 4:
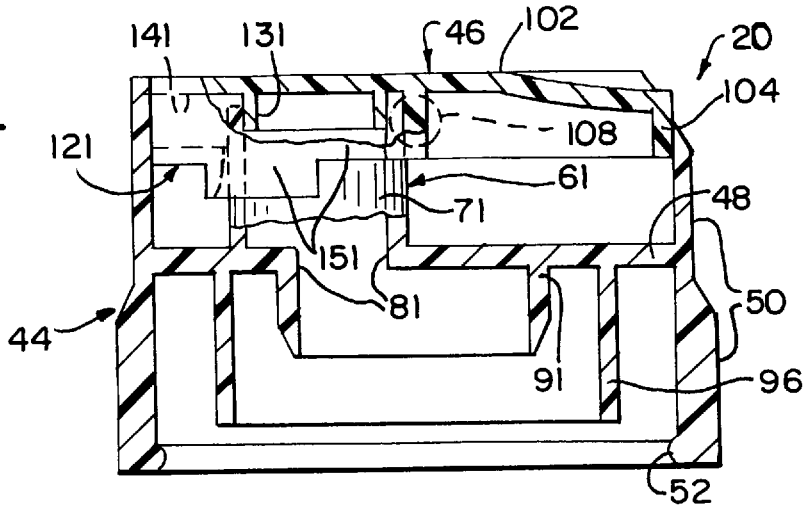
FIG. 4 is a cross-sectional view taken generally along the planes 4—4 in FIG. 2.

As shown in FIG. 1, the closure 20 includes a body 44 and an actuator 46. The body 44 includes a deck 48 surrounded by a peripheral wall 50. The deck 48 is connected at its periphery to the peripheral wall 50. The peripheral wall 50 extends above the deck 48, as can be seen in FIG. 1, to define a central recess 51. The peripheral wall 50 also extends below the deck 48 as can be seen in FIG. 4.

Figure 5:
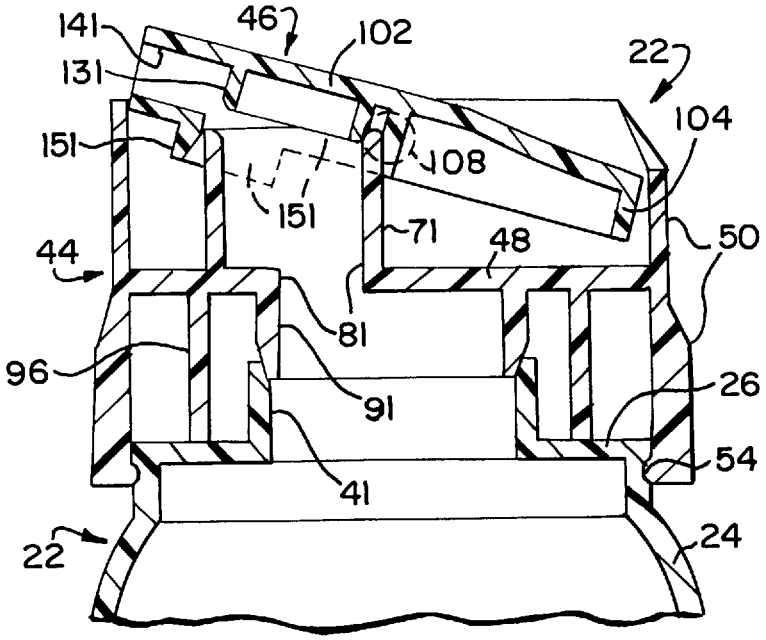
FIG. 5 is a cross-sectional view taken generally along the planes 5—5 in FIG. 3.

The bottom, inner edge of the peripheral wall 50 defines an inwardly directed, annular bead 52. The bead 52 is used to establish a snap-fit engagement holding the dispensing structure or closure 20 on the container 22 as shown in FIG. 5. The body 24 of the container 22 defines an inwardly concave, annular groove 54 below the end wall 26 as shown in FIG. 5. The groove 54 receives the closure annular bead 52 in a snap-fit engagement.

The closure body 44 defines a first discharge conduit 61 and a second discharge conduit 62 as illustrated in FIG. 1. The first discharge conduit 61 includes a first upper tube 71 projecting upwardly from the deck 48 around a first aperture 81 and further includes a first lower tube 91 projecting downwardly from the deck 48 around the first aperture 81 (FIG. 4). Similarly, the second discharge conduit 62 includes a second upper tube.72 projecting upwardly from the deck 48 around a second aperture 82 (FIG. 6) and includes a lower tube 92 projecting downwardly from the deck 48 around the second aperture 82.

As can be seen in FIG. 5, when the closure 20 is mounted to the container 22, the closure body first lower tube 91 is received in, and sealingly engages the interior edge of, the container first outlet tube 41. Similarly, the closure body second lower tube 92 is adapted to be received in, and sealingly engage the interior edge of, the container second outlet tube 42.

Figure 6:
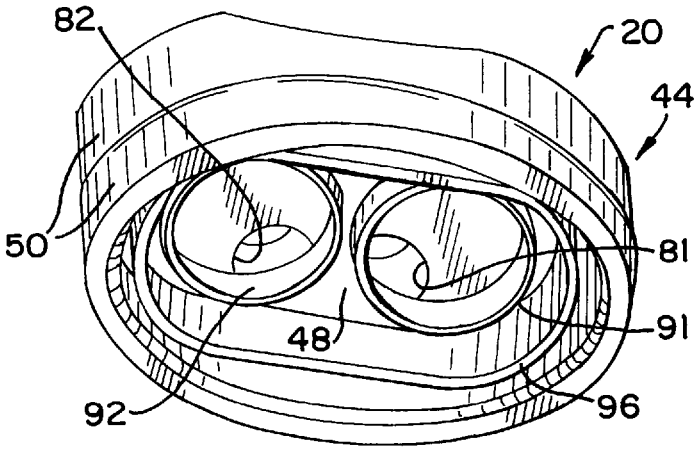
FIG. 6 is a bottom, perspective view of the dispensing structure shown in FIG. 3.

As illustrated in FIGS. 4–6, the body first lower tube 91 and the body second lower tube 92 are generally cylindrical, and each lower tube defines an axis. The body first upper tube 71 and the body second upper tube 72 are generally cylindrical, and each defines an axis. The axis of the body first upper tube 71 is offset relative to the axis of the body first lower tube 91. Similarly, the axis of the body second upper tube 72 is offset from the axis of the body second lower tube 92. In this embodiment, the offset between the upper and lower tubes determines the shapes of the apertures 81 and 82. The apertures 81 and 82 do not define completely circular openings. Rather, the apertures 81 and 82 define only partially circular openings.

Preferably, as illustrated in FIGS. 4–6, the closure body 44 also includes an interior wall 96. Interior wall 96 depends downwardly from the deck 48 within the peripheral wall 50 around the first lower tube 91 and second lower tube 92.

Figure 7:
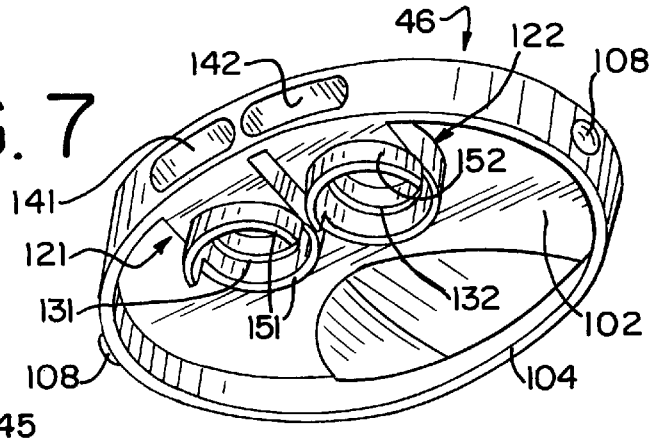
FIG. 7 is a bottom, perspective view of the actuator removed from the dispensing structure shown in FIG. 1.

The actuator 46 is a generally disk-like nozzle structure. As shown in FIGS. 1 and 7, the actuator 46 includes a transverse top wall 102 and a peripheral flange 104. On the flange 104, there are two, oppositely directed engageable surfaces in the form of hemispherical members 108 (FIGS. 1 and 7).

Figure 2:
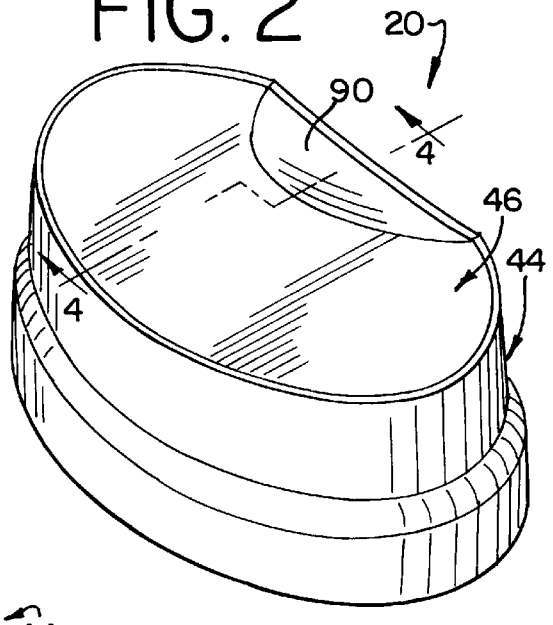
FIG. 2 is a front perspective view of the closed dispensing structure.

The closure body peripheral wall 50 defines two spaced-apart engaging surfaces in the form of concave recesses 112 (FIG. 1). The recesses 112 are spaced apart on opposite sides of the central recess 51 defined by the body peripheral wall 50. The engaging surfaces or recesses 112 define a pivot axis extending across a portion of the central recess 51. The actuator members 108 are adapted to be received within the body recesses 112. The body peripheral wall 50 has sufficient flexibility or resiliency to accommodate a slight outward deflection, at least in the regions of the recesses 112, to accommodate insertion of the actuator 46 into the closure body 44 and to facilitate a mating, snap-fit engagement between each of the members 108 and one of the recesses 112. This establishes a pivotal mounting of the actuator 46 in the closure body 44 and accommodates tilting of the actuator 46 between an upwardly angled, dispensing, open position (FIGS. 3 and 5) an a lowered, generally horizontal, non-dispensing, closed position (FIGS. 2 and 4).

The actuator 46 can be pivoted to the upwardly tilted position by pushing downwardly on a concave surface or finger well 90 (FIGS. 1, 2, and 3) which is adapted to receive the end of a thumb or finger. The actuator 46 can be returned to the closed position by pushing down on the front part of the actuator 46.

Figure 3:
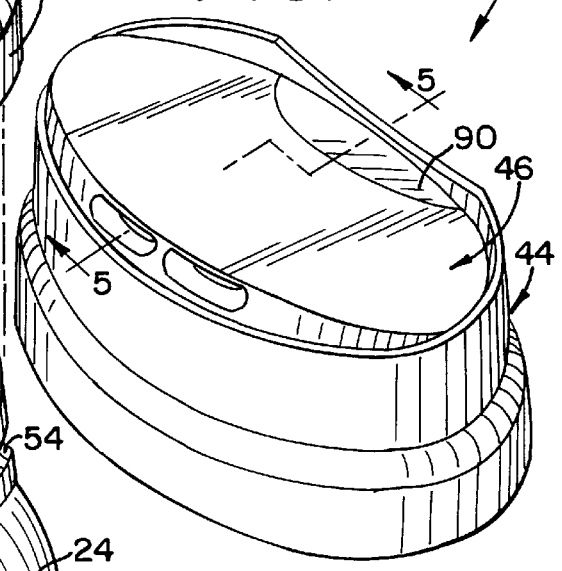
FIG. 3 is a front perspective view of the dispensing structure shown with the actuator tilted to the dispensing, open position.

In some applications, it may be desirable to provide the actuator 46 with a rearwardly extending, angled cam (not illustrated) for engaging the inside of the peripheral wall 50 on the body as the actuator 46 is tilted upwardly (to the position shown in FIG. 3). Such a rearwardly extending cam slides against the inside surface of the peripheral wall 50 and serves to stabilize the actuator 46 as it is being pivoted. The cam provides a frictional engagement to maintain the actuator in the tilted, open position. Such a conventional cam is described and illustrated in the U.S. Pat. No. 5,341,960 which is incorporated herein by reference thereto to the extent not inconsistent herewith. The cam is designated in the U.S. Pat. No. 5,341,960 by the reference number 98. The detailed design and operation of such an optional cam forms no part of the present invention.

As shown in FIG. 7, the actuator has a first dispensing conduit 121 and a second dispensing conduit 122. The first dispensing conduit 121 includes a first sealing member or plug 131, and the second dispensing conduit 122 includes a second sealing member or plug 132. The first dispensing conduit 121 defines an internal dispensing passage 141 which opens to the front of the actuator 46, and the second dispensing conduit 122 defines a second dispensing passage 142 which opens to the front of the actuator 46.

The first dispensing conduit 121 also includes a first, stepped, cylindrical, sealing wall 151, and the second dispensing conduit 122 similarly includes a second, stepped, partially cylindrical, sealing wall 152. As shown in FIG. 4, the first sealing wall 151 seals around the outer periphery of the closure body first upper tube 71. Similarly, the second sealing wall 152 seals around the outer periphery of the second upper tube 72. Even when the actuator is in the tilted, open position as shown in FIG. 5, the sealing walls 151 and 152 still seal against the outer surfaces of the first and second upper tubes 71 and 72, respectively. When the actuator 46 is in the closed position, and when the actuator 46 is in the open position, each upper tube 71 and 72 is sealed about its periphery by the cylindrical walls 151 and 152, respectively.

As illustrated in FIGS. 4, 5, and 7, the first sealing plug 131 projects downwardly from the bottom of the actuator top wall 102. The first sealing plug 151 has a generally cylindrical or annular configuration and is adapted to enter into the opening at the top of the first upper tube 71 to sealingly occlude the tube 71 when the actuator 46 is in the closed position as illustrated in FIG. 4. The second sealing plug 132 functions in a similar manner with respect to the second upper tube 72. On the other hand, when the actuator 46 is tilted to the open, dispensing position as illustrated in FIGS. 3 and 5, then the front portion of each sealing plug is tilted away from the associated upper tube so as to permit flow of material out of the tubes and through the dispensing passages 141 and 142.

The container 22 can be squeezed, or otherwise operated, to force the material in each of the compartments upwardly through the outlet tubes 41 and 42 in the end of the container, through the closure body lower tubes 91 and 92, through the closure body upper tubes 71 and 72, and out of the open actuator dispensing passages 141 and 142. As previously explained, the means by which the material is forced out of the container, and any special construction for facilitating such discharge of material from the container, form no part of the present invention.

Because the container 22 has two internal compartments containing two different materials, each of the materials can be forced out of the container simultaneously and can be dispensed from the actuator simultaneously as two side-by-side streams which can then be used—typically by mixing the two streams together. After the desired quantity of the materials have been dispensed, the actuator 46 is pushed to the closed position (FIGS. 2 and 4). The sealing plugs 131 and 132 then close against the closure body first upper tube 71 and second upper tube 72, respectively, to seal the container contents from the, atmosphere and to prevent contaminant ingress.

FIGS. 8–14 illustrate a second embodiment of the present invention which is illustrated therein as a closure designated generally by the reference 200. The closure 200 includes a body 244 having a peripheral wall 250. The closure body 244 includes a central wall 243 merging at each end with the peripheral wall 250.

The central wall 243 and the peripheral wall 250 together define a first recess 245 and a second recess 247. The recesses 245 and 247 are separated by the central wall 243. The bottoms of the recesses 246 and 247 are defined by a generally horizontal deck 248.

Figure 14:
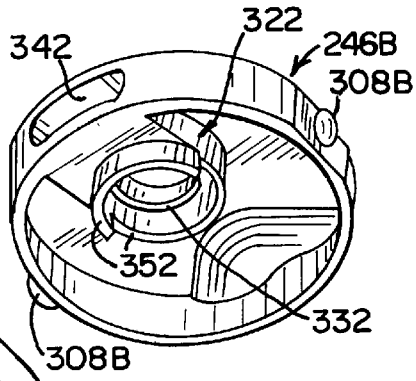
FIG. 14 is a bottom perspective view of one of the two actuators employed in the dispensing structure illustrated in FIGS. 8–13.
Figure 9:
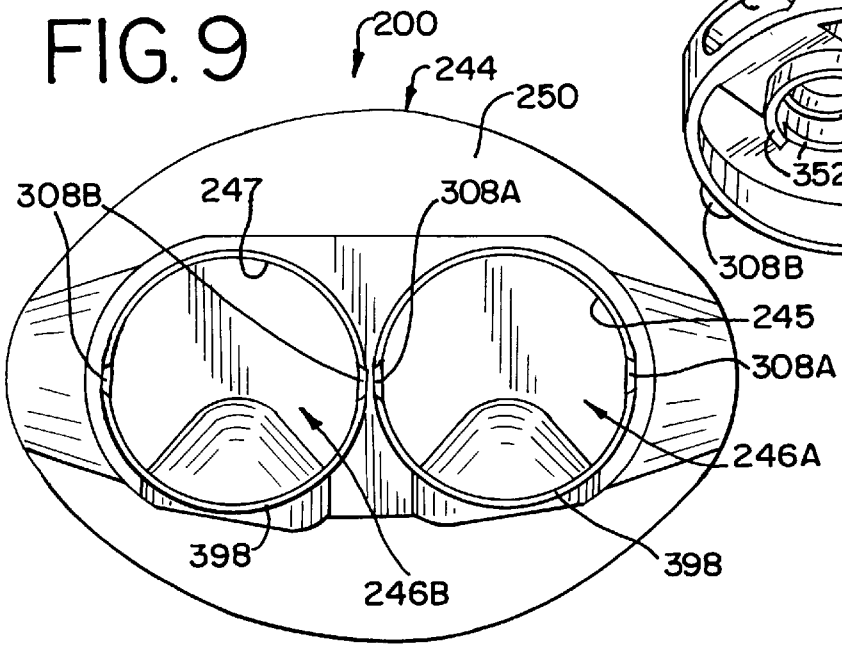
FIG. 9 is a top plan view of the dispensing structure shown in FIG. 8.

The first recess 245 is adapted to receive a first actuator 246A, and the second recess 247 is adapted to receive a second actuator 246B. The second actuator 246B has two oppositely directed engageable surfaces or hemispherical members 308B (FIG. 14). These are adapted to be received in two spaced-apart engaging surfaces or recesses in the closure body peripheral wall 250, one of which recesses 312B is visible in FIG. 13.

The first actuator 246A has a similar pair of oppositely directed engageable surfaces or hemispherical members 308A (FIG. 9) for being received in spaced-apart engaging surfaces or recesses (not visible) which are similar to the recesses 312B illustrated in FIG. 13.

Each actuator 246A and 246B is adapted to be mounted in the closure body in a snap-fit engagement in substantially the same manner as described above with respect to the first embodiment of the actuator 46 and closure body 44 illustrated in FIGS. 1–7. The actuators 246A and 246B are normally oriented in a non-dispensing, closed position (FIGS. 8, 9, 10, and 11). Each actuator 246A and 246B can be independently tilted to a dispensing, open position such as illustrated for the second actuator 246B in FIG. 12.

The first actuator 246A has a finger well 290A, and the second actuator 246B has a finger well 290B. Each of the finger wells can be pressed downwardly with a finger thumb to tilt the actuators to the open positions. The actuators can be returned to the closed positions by pushing downwardly on the front part of each actuator.

Figure 8:
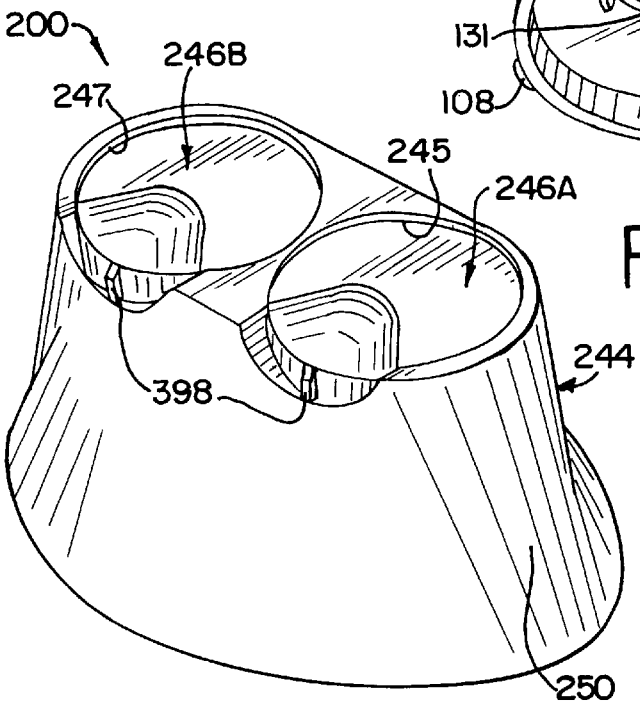
FIG. 8 is a rear perspective view of a second embodiment of the dispensing structure.

Preferably, each actuator includes a rearwardly extending cam 398 (FIG. 8). Each cam 398 is adapted to engage the inside surface of the closure body wall 250 as each actuator is tilted upwardly. This stabilizes the operation of each actuator and holds each actuator open owing to frictional engagement established between the cam 398 and the closure body peripheral wall 250.

The closure body 244 is adapted to be mounted to the top of a container (not illustrated) which may have separate, internal compartments, such as in the container 22 described above with respect to the first embodiment illustrated in FIGS. 1–7. To this end, the closure body 244 may include a snap-fit bead along the bottom edge (not illustrated) for engaging an annular groove on the container (such as the annular groove 54 in the container 22 described above with reference to the first embodiment illustrated in FIGS. 1–7). Alternatively, the closure body 244 may be provided as a unitary part, or extension, of the container.

The closure body 244 includes a pair of discharge conduits, and a discharge conduit 272 is visible in FIG. 13 under the second actuator 246B. A similar discharge conduit is provided under the first actuator 246A, but is not visible in FIG. 13. Each discharge conduit is adapted to communicate with a corresponding discharge opening or tube in the container (not illustrated) which in turn communicate with separate storage compartments in the container.

Each actuator 246A and 246B has the same construction. The structure of the second actuator 246B is illustrated in detail in FIG. 14. The actuator 246B includes a dispensing conduit 322 defining a dispensing passage 342 and having a sealing plug 332. The dispensing conduit 322 also includes a stepped, cylindrical, sealing wall 352 for sealingly engaging the exterior surface of the upwardly projecting upper tube 272 in the closure body 244. The actuator 246B, including the structure of the dispensing conduit 322 defined therein, functions in generally the same manner as the actuator 46 and dispensing conduit 122 described above in detail reference to the first embodiment illustrated in FIGS. 1–7. The other actuator 246A of the second embodiment has a structure identical with that of the actuator 246B and operates in the same manner.

Both actuators 246A and 246B can be in the closed position at the same time or in the open position at the same time. Alternatively, one actuator may be closed while the other is open. This arrangement permits different products in the two different container compartments to be dispensed separately or together.

It will be readily observed from the foregoing detailed description of the invention and from the illustrations thereof that numerous other variations and modifications may be effected without departing from the true spirit and scope of the novel concepts or principles of this invention.

What is claimed is:

1. A dispensing structure for a container having first and second storage compartments and first and second discharge openings each separately communicating with one of said first and second storage compartments, respectively, said dispensing structure comprising:

a body for extending from said container, said body having a peripheral wall and defining first and second discharge conduits for communicating with said first and second discharge openings, respectively; and first and second dispensing conduits mounted in said body peripheral wall for tilting movement between (1) a dispensing, open position in which said first and second dispensing conduits are in fluid communication with said first and second discharge conduits, respectively, and (2) a non-dispensing, closed position, said first and second dispensing conduits including, respectively, first and second sealing members therein for occluding flow from said first and second discharge conduits, respectively, when said first and second dispensing conduits are in said closed position and for permitting flow from said first and second discharge conduits when said first and second dispensing conduits are in said open position.

2. The dispensing structure in accordance with claim 1 in which said body is a unitary molded element separate from, but attachable to, said container.

3. The dispensing structure in accordance with claim 1 in which said body peripheral wall defines a central recess around said first and second discharge conduits; and said first and second dispensing conduits are defined in a single actuator pivotally mounted to said body peripheral wall in said central recess.

4. The dispensing structure in accordance with claim 1 in which said peripheral wall defines two spaced-apart engaging surfaces defining a pivot axis extending across a portion of said central recess; and said actuator defines two oppositely directed engageable surfaces which are each matingly engaged with one of said peripheral wall engaging surfaces to pivotally mount said actuator to said peripheral wall.

5. The dispensing structure in accordance with claim 1 in which said body includes a central wall between said first and second discharge conduits;

said body central wall and said peripheral wall together define first and second separated recesses around said first and second discharge conduits, respectively, said first and second dispensing conduits are each separately defined in first and second actuators, respectively; and said first and second actuators are pivotally mounted to said body in said first and second recess, respectively.

6. The dispensing structure in accordance with claim 5 in which said peripheral wall and said central wall define a first pair of spaced-apart engaging surfaces defining a first pivot axis extending across a portion of said first recess;

said first actuator defines two oppositely directed engageable surfaces which are each matingly engaged with one of said first pair of engaging surfaces;

said peripheral wall and said central wall define a second pair of spaced-apart engaging surfaces defining a second pivot axis extending across a portion of said first recess;

said second pivot axis being collinear with said first pivot axis; and said second actuator defines two oppositely directed engageable surfaces which are each matingly engaged with one of said second pair of engaging surfaces.

7. The dispensing structure in accordance with claim 1 in which said dispensing structure is adapted for use with the container wherein the container has an end wall and wherein the container first and second discharge openings are defined by first and second outlet tubes, respectively, projecting from the end wall of the container;

said dispensing structure is a separate closure adapted to be mounted over the end wall of the container;

said body includes a snap-fit element for establishing a snap-fit engagement with a cooperating snap-fit element on said container to mount said body on said container; and said body includes (1) a deck, (2) first and second apertures in said deck, (3) first and second lower tubes projecting downwardly from said deck around said first and second apertures, respectively, and (4) first and second upper tubes projecting upwardly from said deck around said first and second apertures, respectively, whereby said first upper tube and said first lower tube together define said first discharge conduit in said body and whereby said second upper tube and said second lower tube together define said second discharge conduit in said body.

8. The dispensing structure in accordance with claim 7 in which each said sealing member is an annular sealing plug;

each said body lower tube is adapted to be received in, and sealingly engage the interior edge of, one of said container outlet tubes; and each said body upper tube is adapted to be received in, and sealingly engage the exterior edge of, one of said sealing plugs.

9. The dispensing structure in accordance with claim 7 in which each said body first and second lower tube is generally cylindrical and defines an axis;

each said body first and second upper tube is generally cylindrical and defines and axis;

each said body first upper tube axis is offset relative to each said body first lower tube axis; and each said body second upper tube axis is offset relative to each said body second lower tube axis.

10. The dispensing structure in accordance with claim 7 in which said peripheral wall extends below said deck;

said deck is connected at its periphery to said peripheral wall; and said body includes an interior wall depending downwardly from said deck within said peripheral wall around said body first and second lower tubes.

11. The dispensing structure in accordance with claim 7 in which each said body first and second lower tube has a circular transverse cross section with an identical first diameter; and each said body first and second upper tube has a circular transverse cross section with an identical second diameter.

* * * * *